United States Patent [19]

Morikawa et al.

[11] 4,320,959

[45] Mar. 23, 1982

[54] AUXILIARY EXPOSURE DEVICE FOR ELECTROPHOTOGRAPHIC APPARATUS

[75] Inventors: Teruo Morikawa, Sagamihara; Shinji Murata, Tokyo, both of Japan

[73] Assignee: Canon Kabushiki Kaisha, Tokyo, Japan

[21] Appl. No.: 118,925

[22] Filed: Feb. 6, 1980

[30] Foreign Application Priority Data

Feb. 19, 1979 [JP] Japan ..... 54-18802

[51] Int. Cl.[3] ..... G03G 15/04

[52] U.S. Cl. ..... 355/11; 355/66

[58] Field of Search ..... 355/11, 1, 3 R, 7, 66

[56] References Cited

U.S. PATENT DOCUMENTS 3,671,121 6/1972 Albert ..... 355/7

3,724,940 4/1973 Koizumi ..... 355/7 X 3,784,301 1/1974 Sato ..... 355/7

4,025,180 5/1977 Kurita et al. ..... 355/16 X

*Primary Examiner*—R. L. Moses

*Attorney, Agent, or Firm*—Fitzpatrick, Cella, Harper & Scinto

[57] ABSTRACT

An auxiliary exposure device for use in an electrophotographic apparatus is utilized for eliminating unnecessary electrostatic charge from the end portions of the photosensitive member and includes a light reflecting member and light source for auxiliary exposure, wherein the light reflecting member is positioned to maintain the light source and the plane of the original in mutually conjugate relationship, and/or the end portion of the light reflecting member is shaped to match the form of the light beam reflected from the original.

27 Claims, 11 Drawing Figures

AUXILIARY EXPOSURE DEVICE FOR ELECTROPHOTOGRAPHIC APPARATUS

BACKGROUND OF THE INVENTION

1. Field of the Invention

The present invention relates to an auxiliary exposure device for use in an electrophotographic apparatus, and more particularly to a so-called sharp-cut auxiliary exposure device improved, in irradiating end portions of a photosensitive member to form a non-image area thereon, so as to form a clear boundary between the image area and the non-image area.

2. Description of the Prior Art

In an electrophotographic copier or an electrostatic recording apparatus, an electrophotographic image is generally obtained by uniformly charging a photosensitive member for example by corona discharge to provide said member with photosensitivity, then subjecting said photosensitive member to imagewise exposure to form an electrostatic latent image thereon corresponding to an original pattern, and bringing colored charged particles, called toner, close to said photosensitive member to cause selective deposition of said particles onto said electrostatic image thereby obtaining a visible image.

However said uniform charging on the photosensitive member is conventionally conducted over an area wider than the area to be subjected to the imagewise exposure, whereby the end portions of the photosensitive member around the exposed area remain charged because of the absence of exposure and become developed with toner particles resulting in a dirty appearance and in a significiant increease in toner consumption.

Also in an electrophotographic apparatus in which the developed image is transferred onto a transfer material for example a plain paper sheet which is subsequently separated from the photosensitive member, the image area on the photosensitive member is selected narrower than the transfer sheet, and the separation thereof from the photosensitive member is achieved by a separating device such as a separating belt cooperating with the non-image areas located outside said image area. Consequently there may result accumulation of a considerable amount of toner particles in the separating device functioning in contact with the photosensitive member in the areas outside said image area, leading to contamination of said separating device and eventually the obtained copy. Also the toner particles constantly remaining in an elevated amount on the photosensitive member outside the image area gives rise to unnecessary fatigue in the cleaning device used in such apparatus for removing the toner particles remaining on the photosensitive member after the image transfer.

In order to prevent the above-mentioned drawbacks there is already disclosed, for example in the United States Pat. Nos. 3,784,301 and 3,724,940, a method of irradiating the remaining charged area of the photosensitive member with light from an auxiliary light source other than the light source for illuminating the original, thereby avoiding the toner deposition on said area.

FIG. 1 schematically shows a conventional electrophotographic apparatus employing such auxiliary light source, wherein a photosensitive drum 1 receives, through an imaging lens 2, an image of the original in an area 3 of said drum. The effective light beam in this exposure is represented by 4. A transfer sheet 5, after the transfer of the toner image from said drum, is separated from said photosensitive drum by a separating belt 6 positioned therebetween. An area 7 of the drum 1 coming into contact with said separating belt 6 is irradiated by a lamp 8 functioning as the auxiliary light source, of which light emission is defined by a shield 9.

However, in such conventional auxiliary exposure device wherein the light shield 9 is separated from the drum surface an enlarged view being shown in FIG. 2, the boundary portion A between the image area and the non-image area becomes unclear to provide an image with undefined edges since the light from the auxiliary light source 8 overlaps with the original image 4 and further since the stray light from the lamp 8 positioned close to the drum 1 enters the image area through the gap between the shield 9 and said drum 1.

SUMMARY OF THE INVENTION

The object of the present invention is to provide an improved auxiliary exposure device for use in an image forming apparatus.

Another object of the present invention is to provide an auxiliary exposure device capable of preventing formation of unclear edges of the image resulting from the stray light from the auxiliary light source.

Still another object of the present invention is to provide an auxiliary exposure device capable of completely eliminating the remaining charge.

Still another object of the present invention is to provide a sharp-cut exposure device capable of providing the image with clearly cut edges.

Still another object of the present invention is to provide an auxiliary exposure device capable of preventing unnecessary consumption of toner.

Still another object of the present invention is to provide an auxiliary exposure device capable of preventing formation of a dirty copy image involving toner deposition on the peripheral portions of the copy material.

According to the present invention, the above-mentioned objects are achieved by an auxiliary exposure device comprising a light reflecting member positioned between an imaging optical system and an original supporting carriage and auxiliary exposure means for irradiating the photosensitive member with light through said light reflecting member, wherein said auxiliary exposure means is positioned in the vicinity of a position optically conjugate with the focus position on said original supporting carriage with respect to said light reflecting member.

Also in said device the end portion of said light reflecting member is shaped to meet the form of the light beam reflected from the original thereby achieving a clearly cut exposure without unclearness in the end portions of the image area. In such case said auxiliary exposure means need not necessarily be positioned optically conjugate with the plane of the original.

The foregoing as well as other objects and advantages of the present invention will be made fully apparent from the following description to be taken in conjunction with the attached drawings.

DESCRIPTION OF THE PREFERRED EMBODIMENTS

In the following there will be given an explanation on a preferred embodiment of the present invention in which the auxiliary exposure is conducted on an area of the photosensitive member coming into contact with a separating belt.

Figure 1:
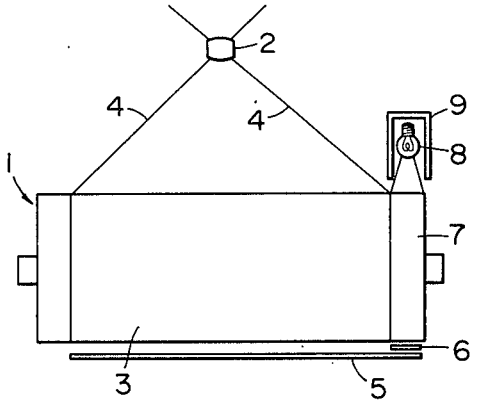
FIG. 1 is a schematic view of a conventional electrophotographic apparatus employing an auxiliary light source.
Figure 2:
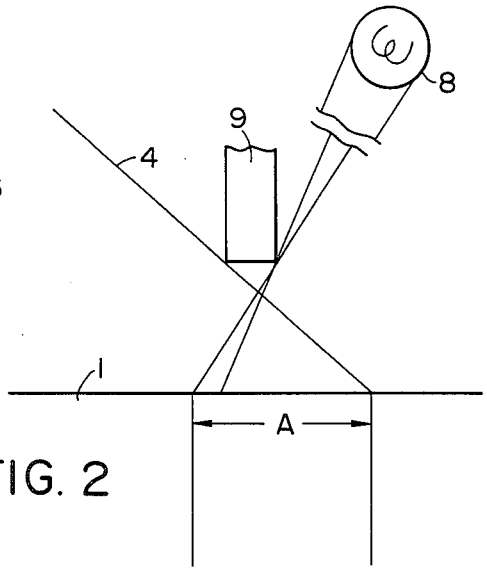
FIG. 2 is a partial magnified view of the conventional apparatus shown in FIG. 1.
Figure 3A:
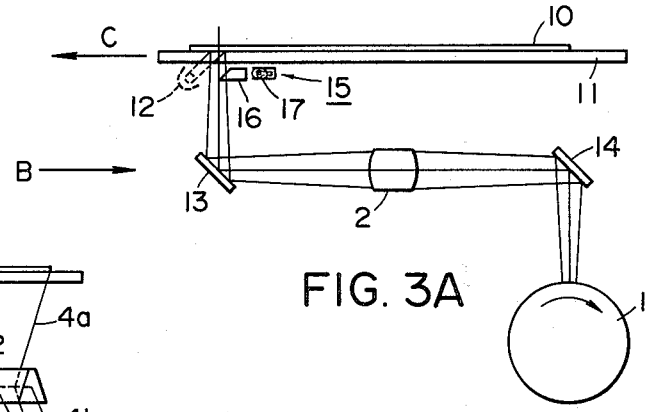
FIG. 3A is a schematic partial view of an electrophotographic apparatus embodying the present invention.
Figure 3B:
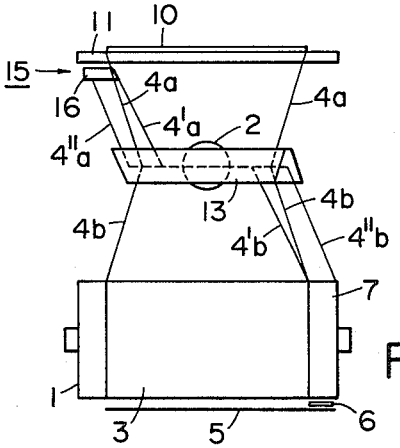
FIG. 3B is a lateral view of said apparatus.

Referring to FIG. 3A showing an electrophotographic apparatus embodying the present invention in a schematic elevation view and also to FIG. 3B showing said apparatus in a lateral view seen from a direction B in FIG. 3A, an original 10 is placed on an original carriage 11 and displaced in a direction C to conduct so-called scanning slit exposure on a photosensitive drum 1 rotated in a direction D. Naturally such exposure can also be achieved by displacing the optical system in place of displacing the original carriage. In such exposure there is naturally required original illuminating means 12 represented by broken lines. The light beam from the original is focused onto said drum 1 through an imaging optical system composed of mirrors 13, 14 and an imaging lens 2.

The sharp-cut exposure device (auxiliary exposure device) 15 of the present embodiment is composed of a light-reflecting member 16 and an illuminating lamp 17, wherein the front end of said light-reflecting member 16 is positioned corresponding to the center of the slit light beam. However such positioning is not necessarily essential, and a sharp-cut exposure can be obtained as long as said light-reflecting member is so positioned as to intersect at least a part of the light beam.

Further referring to FIG. 3B, the sharp-cut exposure device 15 is positioned in such a manner that the light-reflecting member 16 is located between an effective exposure ray 4*a* and another ray 4*a'* constituting an angle viewing the imaging lens 2 from the junction point of the sharp-cut exposure device with the end point of the effective original exposure area. The above-explained structure is selected to obtain a sharp end in the original image as will be explained later.

Rays 4*a''* and 4*b''* define the external boundary of the auxiliary exposure area, and the separating belt 6 is positioned in said area defined by said ray 4*b''* and the effective exposure ray 4*b'*.

Figure 4A:
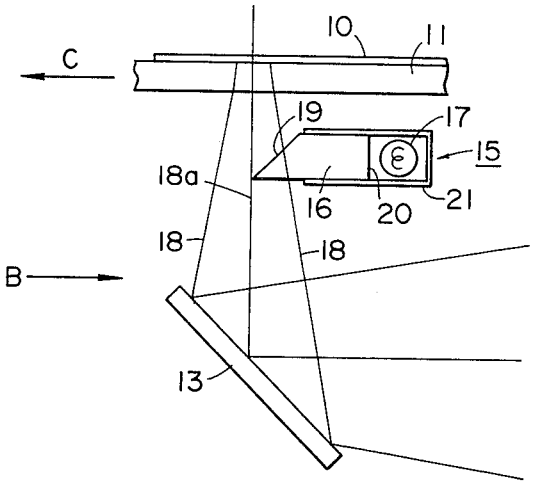
FIG. 4A is a magnified elevation view of a sharp-cut exposure device.
Figure 4B:
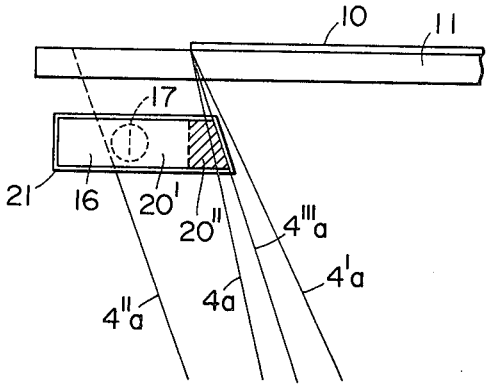
FIG. 4B is a lateral view thereof.

The aforementioned sharp-cut exposure device is shown in magnified scale in an elevation view of FIG. 4A and in a lateral view of FIG. 4B seen from a direction B. In the present embodiment said light-reflecting member 16 is composed of a glass block or a glass prism, of which a slanted mirror face 19 is inserted into the effective exposure light beam 18 approximately to the center thereof and which is provided with a light diffusing face 20 positioned in optically conjugate relation with the original with respect to the slanted face 19. Said light diffusing face 20 is provided, as shown in FIG. 4B, with a sharp-cutting face 20' and an opaque face 20'', and is illuminated with suitable illuminating means such as a lamp 17. In order to avoid stray light, said lamp 17 is naturally covered with a casing 21. The inserted end portion of said prism 16 parallel to the longitudinal direction of the slit is shaped to lie along the ray 4*a'''*.

In designing such prism it is naturally necessary to take the elongation of the optical path by the optical glass into consideration.

Figure 5:
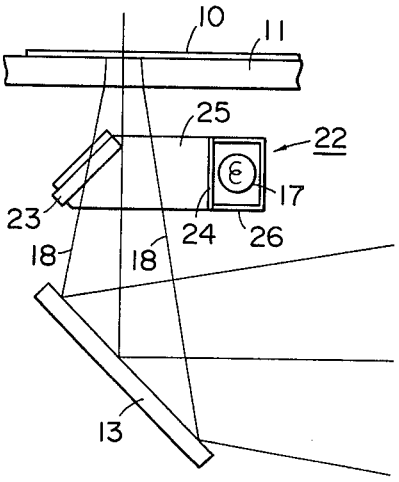
FIG. 5 is an elevation view showing another embodiment of the sharp-cut exposure device.

FIG. 5 shows another embodiment of the present invention in an elevation view, wherein the light-reflecting member is composed of an ordinary mirror in place of a prism. The sharp-cut exposure device 22 comprises a mirror 23, a light-diffusing plate 24 functioning as auxiliary exposure means, an illuminating lamp 17, a support member 25 integrally supporting the foregoing components and a casing 26 for the lamp 17, wherein said light-diffusing plate 24 is positioned in optically conjugate relation with the plane of the original with respect to the mirror 23.

Figure 6A:
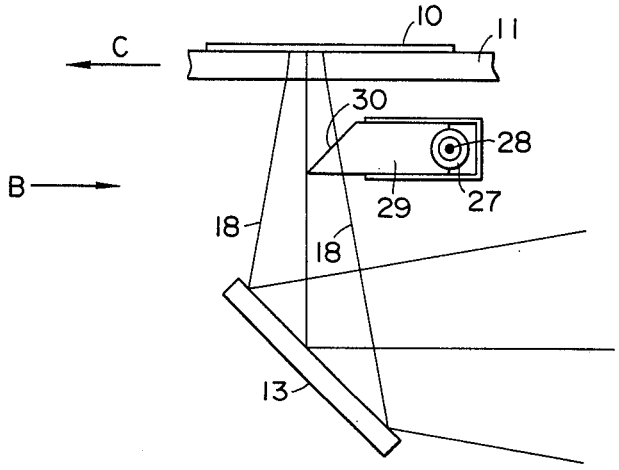
FIG. 6A is an elevation view showing still another embodiment.
Figure 6B:
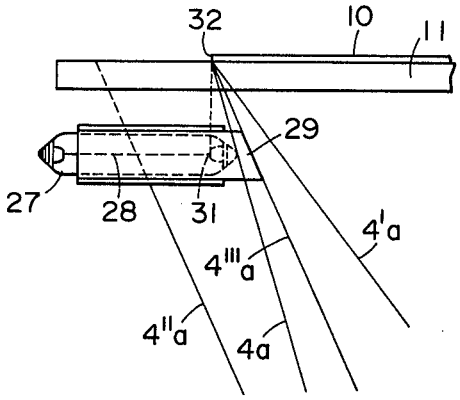
FIG. 6B is a lateral view thereof.

FIGS. 6A and 6B show still another embodiment of the present invention respectively in an elevation view and in a lateral view seen from a direction B, wherein the light generating means for auxiliary exposure is composed of a line filament lamp in place of the combination of a lamp and a diffusing plate shown in FIGS. 4 and 5. As shown in FIG. 6A, a line filament lamp 27 is positioned in such a manner that a line-shaped filament 28 thereof is present on the principal ray deflected by a slanted mirror face 30 of a prism 29 and is in optically conjugate relation with the focus position on the original carriage 11. Also as shown in FIG. 6B, the image-side end point 31 of the line-shaped filament 28 is positioned to coincide with an end 32 of the original 10.

The use of such line-shaped filament provides constant irradiation with a constantly focused light beam in the auxiliary exposure area 7, thus securing effective dissipation of the electrostatic charge in said area 7.

Figure 7A:
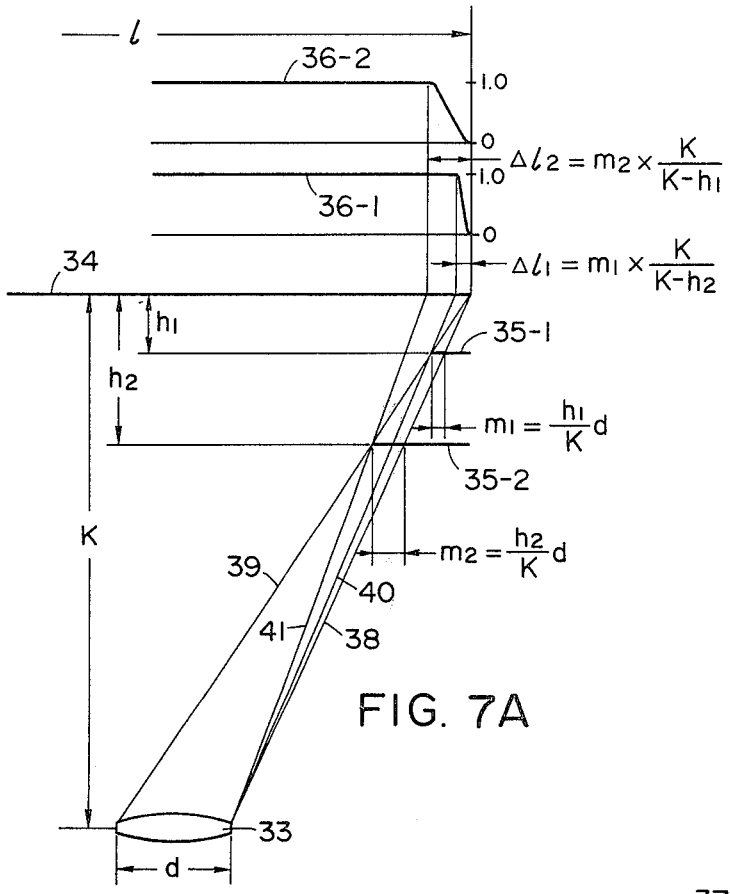
FIGS. 7A and 7B are schematic views showing the relation between the engagement of the sharp-cut exposure device with the illuminating light beam and the unevenness in the illumination.
Figure 7B:
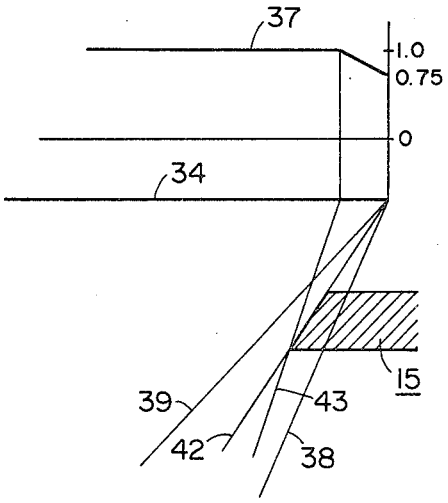

FIGS. 7A and 7B show the relationship between the engagement of the prism or mirror shown in FIGS. 4B, 6B and 7B with the longitudinal end portion of the slit and the eventual illumination in the original exposure.

The amount of said engagement m is represented by $m=h/k \times d$ while the width $\Delta l$ in which the illumination is lowered at the image end portions is represented by $\Delta l=m\times k/(k-h)$, wherein k is the diameter of the pupil of the lens 33, k is the distance from said pupil to the plane 34 of original exposure, l is the width of original exposure and h is the distance from said plane 34 to the position 35 of the sharp-cut exposure device, and said amount of engagement is such that the sharp-cut exposure device is inserted to fully cover the angle of the lens pupil viewed from the end position of the original.

In such case the illumination curve assumes such a form that the illumination decreases from 100% to 0% within said width $\Delta l$. As a numerical example said width $\Delta l$ is equal to 2.63 mm for the values $k=500$ mm, $l=300$ mm, $d=50$ mm and $h=25$ mm. In order that the unevenness in the illumination is practically negligibly small, said width $\Delta l$ should be selected smaller than 1 mm and the amount of illumination declining therein should be as small as possible to retain an illumination intensity of ideally 100%, or practically at least 75% at the end of the image area. According to the present invention, the unevenness in the illumination can be retained in the above-mentioned practically acceptable range by selecting the engagement of the light-reflecting member into the effective light beam within a range from 0 to a half of the angle of the lens pupil viewed from the end position of the original, also in consideration of the ease in the assembling operation in the manufacturing process.

FIG. 7B shows an example in which the illumination intensity at the image end position is retained at 75%, as shown in the curve 37, by selecting said amount of engagement as equal to a half of said angle and further by selecting the amount of engagement in the width direction of the slit as equal to a half of the slit width, or to a position corresponding to the center of the beam in the transversal direction of the slit. The numerals 38 to 43 represent various rays from the lens to the plane of original exposure.

The foregoing explanation on the unevenness in the illumination within the image area is similarly applicable to the illumination within the auxiliary exposure area. Thus the illumination intensities at the boundary with the image area and at the opposite end of the auxiliary exposure area are respectively 100% and 0% in case of zero engagement, while said intensities are respectively 0% and 100% in case said amount of engagement is selected equal to the aforementioned angle. It will naturally be understood that the optimum condition is achieved by preventing the loss of illumination at the boundary of the image area since the exposure in the auxiliary exposure area can be sufficiently achieved by the illuminating lamp therefor.

As detailedly explained in the foregoing, the present invention allows to perform sharply edged auxiliary exposure without the danger of stray light, thus preventing the contamination of the separating means such as the separating belt, and of the obtained copy.

Although the foregoing description is limited to embodiments in which the auxiliary exposure device is provided only on one lateral end portion of the photosensitive member, it will be readily understood that the auxiliary exposure device of the present invention may be provided on both lateral ends of the original carriage or additionally on both longitudinal ends thereof.

What we claim is

1. An electrophotographic apparatus, comprising:

a movable photosensitive member;

an original holder having a surface for placing an original to be copied thereon;

original illiminating means for illuminating the original;

an imaging lens for forming an image of the original on said photosensitive member;

a separate auxiliary light forming means; and a reflecting member for reflecting the light from said auxiliary light forming means, said reflecting member being located optically between said original holder aand said imaging lens and at a position corresponding to an end portion of an area over which the light reflected by the original passes, said auxiliary light forming means being located substantially at a conjugate position with the original surface with respect to said reflecting member, and the light from said auxiliary light forming means is reflected by said reflecting member, and is incident, through said imaging lens, on a portion adjacent an end of the area of said photosensitive member over which an image of the original is formed.

2. An apparatus according to claim 1, wherein said auxiliary light forming means includes a light diffusing surface and a light source for illuminating the diffusing surface.

3. An apparatus according to claim 1, wherein said auxiliary light forming means includes a light emitting element.

4. An apparatus according to claim 1, 2 or 3, wherein said reflecting member includes a mirror.

5. An apparatus according to claim 1, 2 or 3, wherein said reflecting member includes a prism.

6. An apparatus according to claim 2, wherein said reflecting member includes a prism, aand said diffusing surface is opposed to reflecting surface of said prism.

7. An apparatus according to claim 1, 2 or 3, wherein said reflecting member has a portion which projects into the optical path of the light forming an image of the original, said portion having an end collateral with the light for forming an image of the original.

8. An electrophotographic apparatus, comprising:

a movable photosensitive member;

an optical member for scanning an original to be copied to effect slit-exposure of said photosensitive member to image light, said optical member including an original holder for holding an original to be copied, a light source for illuminating the original held on the original holder and an imaging lens for forming an image of the original held by said original holder on an image-forming area of said photosensitive member;

a separate auxiliary light forming means;

a reflecting member for reflecting the light from said auxiliary light forming means, said reflecting member being optically opposed to said auxiliary light forming means and said imaging lens and optically between said original holder and said imaging lens at a position corresponding to an end portion, in a direction perpendicular to the direction of the scan, of an area over which the light reflected by the original passes, wherein the light from said auxiliary light forming means is reflected by said reflecting member, and is incident, through said imaging lens, on a non-image area of said photosensitive member which is adjacent an end, in a direction perpendicular to the direction of the scan, of the image forming area of said photosensitive member; and a separation member, adapted to be interposed between said photosensitive member and a transfer material onto which an image on said photosensitive member is transferred, for separating the transfer material from said photosensitive member after the image is transferred thereto.

9. An apparatus according to claim 8, wherein said auxiliary light forming means includes a light diffusing surface and a light source for illuminating said diffusing surface.

10. An apparatus according to claim 8, wherein said auxiliary light forming means includes a light emitting element.

11. An apparatus according to claim 9, wherein said light emitting element has a filament extending in a direction perpendicular to the scanning direction.

12. An apparatus according to claim 8, 9, 10 or 11, wherein said reflecting member includes a mirror.

13. An apparatus according to claim 8, 9, 10 or 11, wherein said reflecting member includes a prism.

14. An apparatus according to claim 9, wherein said reflecting member includes a prism, and said diffusing surface is opposed to a reflecting surface of said prism.

15. An appartus according to any one of the claims 8 to 11, wherein said reflecting member is positioned in the optical path for image exposure from an end thereof by an amount corresponding to half the angle of the pupil of said imaging lens as viewed from an end position of the image.

16. An apparatus according to claim 15, wherein said reflecting member is positioned in the widthwise direction of the slit at the center of the light beam.

17. An apparatus according to claim 8, 9, 10 or 11, wherein said reflecting member has a portion projecting into the optical path for the light forming an image of the original, said portion of said reflecting member having an end collateral with the light for forming an image of the original.

18. An electrophotographic apparatus, comprising:

a movable photosensitive member;

an optical member for scanning an original to be copied to effect slit-exposure of said photosensitive member to image light, said optical member including an original holder for holding an original to be copied, a light source for illuminating the original held on the original holder and an imaging lens for forming an image of the original on an image forming area of said photosensitive member;

a separate auxiliary light forming means;

a reflecting member for reflecting the light from said auxiliary light forming means, said reflecting member being optically opposed to said imaging lens and optically between said original holder and said imaging lens at a position corresponding to an end portion, in a direction perpendicular to the direction of the scan, of an area over which the light reflected by the original passes, said auxiliary light forming means being located substantially at a conjugate position with the original surface with respect to said reflecting member, and the light from said auxiliary light forming means is reflected by said reflecting member and is incident, through said imaging lens, on a non-image area of said photosensitive member which is adjacent to an end of the image forming area of said photosensitive member; and a separation member adapted to be interposed between said photosensitive member and a transfer material onto which an image on said photosensitive member is transferred, for separating the transfer material from said photosensitive member after the image is transferred thereonto.

19. An apparatus according to claim 18, wherein said auxiliary light forming means includes a light diffusing surface and a light source for illuminating said diffusing surface.

20. An apparatus according to claim 18, wherein said auxiliary light forming means includes a light emitting element.

21. An apparatus according to claim 20, wherein said light emitting element has a filament extending in a direction perpendicular to the scanning direction.

22. An apparatus according to claim 18, 19, 20 or 21, wherein said reflecting member includes a mirror.

23. An apparatus according to claim 18, 19, 20 or 21, wherein said reflecting member includes a prism.

24. An apparatus according to claim 19, wherein said reflecting member includes a prism, and said diffusing surface is opposed to the reflecting surface of said prism.

25. An apparatus according to any one of claims 18 to 21, wherein said reflecting member is positioned in the optical path for image exposure from an end thereof by an amount corresponding to half the angle of the pupil of said imaging lens as viewed from an end position of the image.

26. An apparatus according to claim 25, wherein said reflecting means is positioned in the widthwise direction of the slit, at the center of the light beam.

27. An apparatus according to claim 18, 19, 20 or 21, wherein said reflecting member has a portion which projects into the optical path for the light formation of an image of the original, said portion of said reflecting member having an end collateral with the light for forming an image of the original.

* * * * *

UNITED STATES PATENT AND TRADEMARK OFFICE

CERTIFICATE OF CORRECTION

PATENT NO. : 4,320,959

DATED : March 23, 1982

INVENTOR(S) : TERUO MORIKAWA, ET AL.

It is certified that error appears in the above-identified patent and that said Letters Patent is hereby corrected as shown below:

Column 1, line 34, "increease" should read --increase--

Column 8, line 36, Claim 26, "means" should read --member--.

Signed and Sealed this

*Seventh* Day of *September 1982*

[SEAL]

*Attest:*

GERALD J. MOSSINGHOFF

*Attesting Officer*

*Commissioner of Patents and Trademarks*